US005204906A

United States Patent [19]

Nohara et al.

[11] Patent Number: 5,204,906

[45] Date of Patent: Apr. 20, 1993

[54] VOICE SIGNAL PROCESSING DEVICE

[75] Inventors: Akira Nohara, Nishinomiya; Joji Kane, Nara, both of Japan

[73] Assignee: Matsushita Electric Industrial Co., Ltd., Japan

[21] Appl. No.: 637,271

[22] Filed: Jan. 3, 1991

[30] Foreign Application Priority Data

Feb. 13, 1990 [JP] Japan ..... 2-033210
Feb. 13, 1990 [JP] Japan ..... 2-033211

[51] Int. Cl.[5] ..... G10L 5/00
[52] U.S. Cl. ..... 381/36
[58] Field of Search ..... 381/29, 37, 39, 49

[56] References Cited

U.S. PATENT DOCUMENTS 3,566,035 2/1971 Noll .
4,058,676 11/1977 Wilkes ..... 381/29
4,630,305 12/1986 Borth et al. .

FOREIGN PATENT DOCUMENTS 8807739 of 0000 World Int. Prop. O. .

OTHER PUBLICATIONS

The Journal of the Acoustical Society of America, vol. 41, No. 2, pp. 293-309, A. M. Noll and pp. 295-297; 302-305; 307-309.
Proceedings of the International Conference on Industrial Electronics Control and Instrumentation, Nov. 1987, pp. 997-1002 R. J. Conway et al.
Proceedings of International Conference on Acoustics, Speech & Signal Processing, Mar. 1984, pp. 18A.5.1-4, B. A. Hanson et al; P. 18A.5.2-3.

*Primary Examiner*—Emanuel S. Kemeny
*Attorney, Agent, or Firm*—Beveridge, DeGrandi, Weilacher

[57] ABSTRACT

A noise-contained voice signal is cepstrum-analyzed to determine a peak and a mean-value thereof. When a peak is present, the signal is determined to be a vowel portion, and when a mean-value is large, the signal is determined to be a consonant portion, thereby allowing a voice portion to be accurately determined. Further, utilizing the detected result, noise is accurately canceled.

6 Claims, 8 Drawing Sheets

INPUT WAVEFORM
t
FOURIER TRANSFORMING

INPUT WAVEFORM SPECTRUM
A
t

PREDICTED NOISE SPECTRUM
B
t

A-B
t
INVERSE-FOURIER TRANSFORMING

OUTPUT WAVEFORM
t

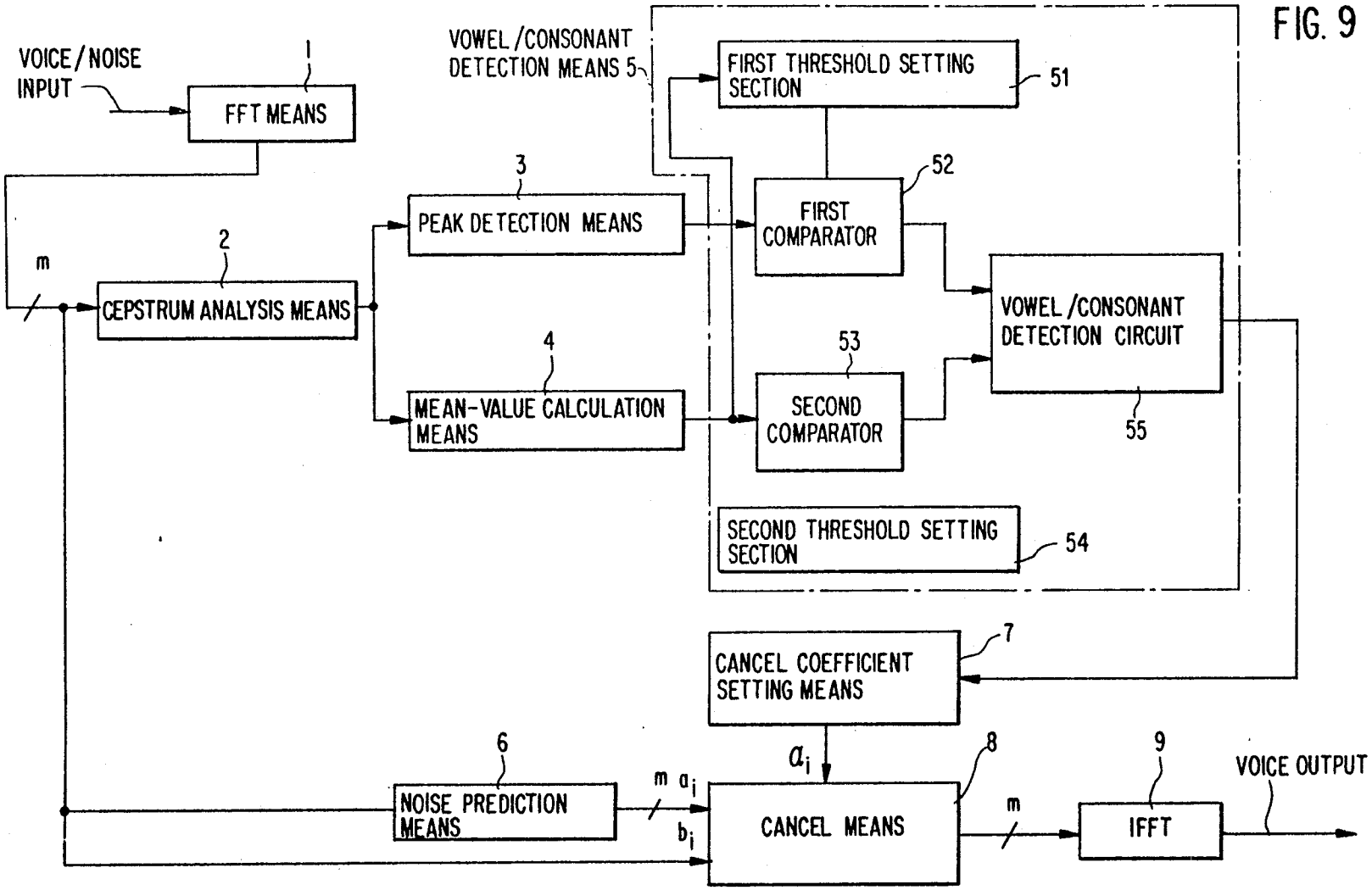
FIG. 9
VOICE/NOISE INPUT
FFT MEANS
1
CEPSTRUM ANALYSIS MEANS
2
m
PEAK DETECTION MEANS
3
MEAN-VALUE CALCULATION MEANS
4
VOWEL/CONSONANT DETECTION MEANS 5
FIRST THRESHOLD SETTING SECTION
51
FIRST COMPARATOR
52
SECOND COMPARATOR
53
VOWEL/CONSONANT DETECTION CIRCUIT
55
SECOND THRESHOLD SETTING SECTION
54
CANCEL COEFFICIENT SETTING MEANS
7
$a_i$
CANCEL MEANS
8
m
IFFT
9
VOICE OUTPUT
m $a_i$
$b_i$
NOISE PREDICTION MEANS
6

VOICE SIGNAL PROCESSING DEVICE

BACKGROUND OF THE INVENTION

1. Field of the Invention

The present invention relates to a voice signal processing device capable of detecting a vowel / a consonant from a voice signal.

2. Description of the Related Art

FIG. 1 is a block diagram of a prior art signal processing device. The numeral 11 indicates a filter control section into which a signal containing a noise, is inputted and which detects the signal or the noise, the numeral 12 indicates a BPF group having numerous band-pass filters, and the numeral 13 indicates an adder. That is, the filter control section 11 controls a filter coefficient of the BPF group in response to the noise or signal of an input signal, and the BPF group 12 has band-pass filters configured in a manner to divide the input signal into the proper bands and determine the pass band characteristic by a control signal from the filter control section 11.

The operation of the prior art signal processing device configured as described above will be explained hereinafter.

An input signal in which a voice is superimposed by a noise is supplied to the filter control section 11. The filter control section 11 determines from the supplied signal a noise component corresponding to each band of the BPF group 12, and supplies a filter coefficient which allows the noise component not to pass through the BPF group 12 to the BPF group 12.

The BPF group 12 divides the input signal into proper bands, allows the input signal to pass through as appropriate by utilizing the filter coefficient inputted from the filter control section 11 for each band, and supplies the signal to the adder 13. The adder 13 mixes signals divided by the BPF group 12 into proper bands to obtain an output.

With the above operation, the pass level of noise-contained bands of the input signal is decreased by the BPF group 12. As a result, a signal having an attenuated-noise component is obtained.

However, the numerousness of noise is not always coincident with articulation and accordingly, a prior art signal processing device has a problem in that a noise can be held down, but the articulation is not improved.

SUMMARY OF THE INVENTION

The present invention intends to offer such a voice signal processing device capable of detecting a vowel and a consonant.

A first embodiment of a voice signal processing device comprises:

frequency analysis means for frequency analyzing a voice input signal;

pitch extraction-analysis means for pitch extracting and analyzing the output from the frequency analysis means;

pitch detection means for detecting a pitch of the pitch-extracted and analyzed output;

mean-value calculation means for calculating a mean-value level of the analyzed output from the pitch extraction-analysis means; and vowel/consonant detection means for detecting a vowel and a consonant, on the basis of the pitch-detected information from the pitch detection means and of the mean-value information from the mean-value calculation means, by determining a vowel according to the pitch and determining a consonant according to the mean-value information level.

A second embodiment of a voice signal processing device comprises:

band division means for band dividing a voice input signal;

cepstrum analysis means for cepstrum analyzing the band-divided output;

peak detection means for detecting a cepstrum peak of the cepstrum-analyzed output from the cepstrum analysis means;

mean-value calculation means for calculating a mean-value level of the cepstrum-analyzed output from the cepstrum analysis means; and vowel/consonant detection means for detecting a vowel from a consonant, on the basis of the peak-detected information from the peak detection means and of the mean-value information from the mean-value calculation means, by determining a vowel according to the peak and determining a consonant according to the mean-value information level.

The voice signal processing device of the second embodiment could have a vowel/consonant detection means comprising;

a first comparator for comparing the detected peak by the peak detection means with a threshold set by a first threshold setting section;

a second comparator for comparing the calculated mean-value by the mean-value calculation means with a specified threshold set by a second threshold setting section; and vowel/consonant detection circuit for detecting a vowel and a consonant on the basis of the compared results from the first and the second comparators, and for outputting the detected result.

And the present invention intends to offer voice signal processing device capable of detecting a vowel and a consonant and suppressing noise by use of the detected result, thereby to obtain good articulated signal.

A third embodiment of a voice signal processing device comprises:

frequency analysis means for frequency analyzing a voice input signal;

cepstrum analysis means for cepstrum analyzing the frequency-analyzed output from the frequency analysis means;

peak detection means for detecting a cepstrum peak of the cepstrum-analyzed output from the cepstrum analysis means;

mean-value calculation means for calculating a mean-value level of the cepstrum-analyzed output from the cepstrum analysis means;

vowel/consonant detection means for detecting a vowel and a consonant, on the basis of the peak-detected information from the peak detection means and of the mean-value information from the mean-value calculation means, by determining a vowel according to the peak and determining a consonant according to the mean-value information level;

cancel coefficient setting means for setting a cancel coefficient utilizing the detected result of the vowel/-consonant detection means;

noise prediction means into which the Fourier-transformed voice signal is inputted and which predicts the noise component thereof;

cancel means into which the noise-predicted output from the noise prediction means, the voice signal, and the cancel coefficient signal set by the cancel coefficient setting means are inputted, and which cancels a noise component considering the cancel ratio from the voice signal; and signal composition means for composing the canceled output from the cancel means.

A fourth embodiment of a voice signal processing device of claim 5 comprises:

band division means for band dividing a voice input signal;

cepstrum analysis means for cepstrum analyzing the band-divided output from the band division means;

peak detection means for detecting a cepstrum peak of the cepstrum-analyzed output from the cepstrum analysis means;

mean-value calculation means for calculating a mean-value level of the cepstrum-analyzed output from the cepstrum analysis means;

vowel/consonant detection means for detecting a vowel from a consonant, on the basis of the peak-detected information from the peak detection means and of the mean-value information from the mean-value calculation means, by determining a vowel according to the peak and determining a consonant according to the mean-value information level;

cancel coefficient setting means for setting a cancel coefficient utilizing the discriminated result of the vowel/consonant detection means;

noise prediction means into which the Fourier-transformed voice signal is inputted and which predicts the noise component thereof;

cancel means into which the noise-predicted output from the noise prediction means, the voice signal, and the cancel coefficient signal set by the cancel coefficient setting means are inputted, and which cancels a noise component considering the cancel ratio from the voice signal; and band composition means for band composing the canceled output from the cancel means.

The voice signal processing device of the fourth embodiment could have a vowel/consonant detection means comprising at least:

a first comparator for comparing the detected peak by the peak detection means with a first threshold set by a threshold setting section;

a second comparator for comparing the calculated mean-value by the mean-value calculation means with a specified threshold set by a second threshold setting section; and vowel/consonant detection circuit for detecting a vowel and a consonant on the basis of the compared results from the first and the second comparators, and outputting the detected result.

BRIEF DESCRIPTION OF THE DRAWINGS

FIG. 9 is a block diagram showing yet another embodiment of a voice signal processing device according to the present invention.

DESCRIPTION OF THE PREFERRED EMBODIMENTS

Figure 1:
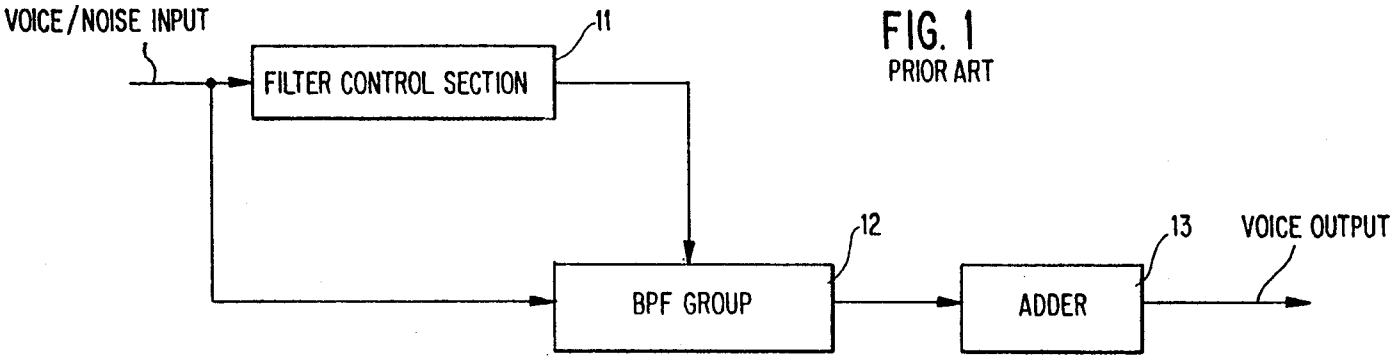
FIG. 1 PRIOR ART
FIG. 1 is a block diagram showing a prior art voice signal processing device.
Figure 2:
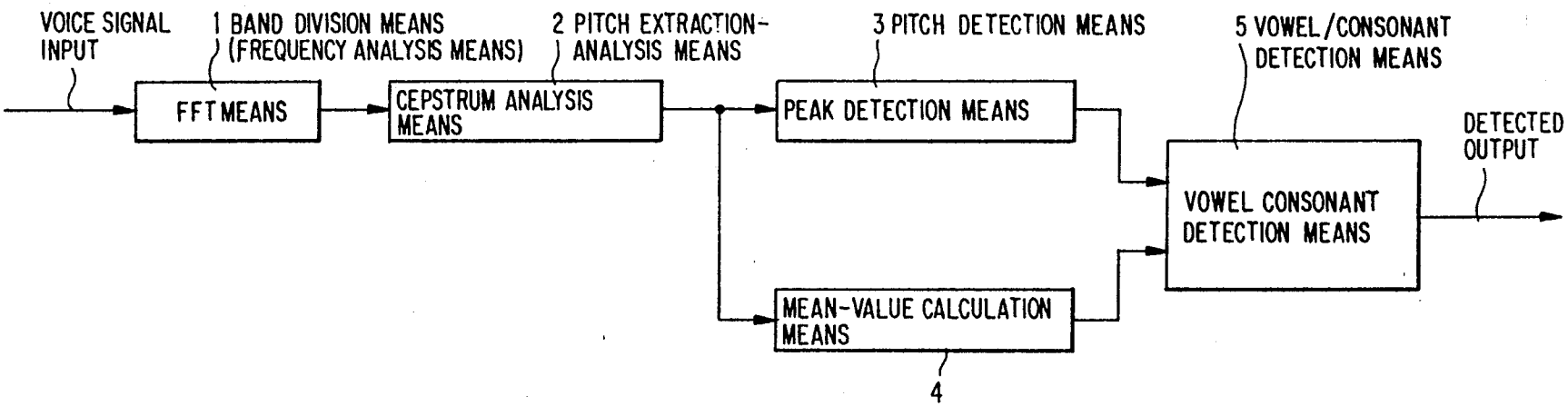
FIG. 2 is a block diagram showing an embodiment of a voice signal processing device according to the present invention.

FIG. 2 is a block diagram of a voice signal processing device in an embodiment of the present invention. In FIG. 2, the numeral 1 indicates band division means as an example of frequency analysis means for frequency-analyzing a signal, in particular, FFT means for Fourier transforming a signal, the numeral 2 indicates cepstrum analysis means for performing cepstrum analysis as an example of a pitch extraction-analysis means, the numeral 3 indicates peak detection means as an example of a pitch detection means for detecting a peak of a cepstrum distribution, the numeral 4 indicates mean-value calculation means for calculating the mean-value of the cepstrum distribution, and the numeral 5 indicates vowel/consonant detection means for detecting a vowel and a consonant from input signals containing noise.

Figure 3A:
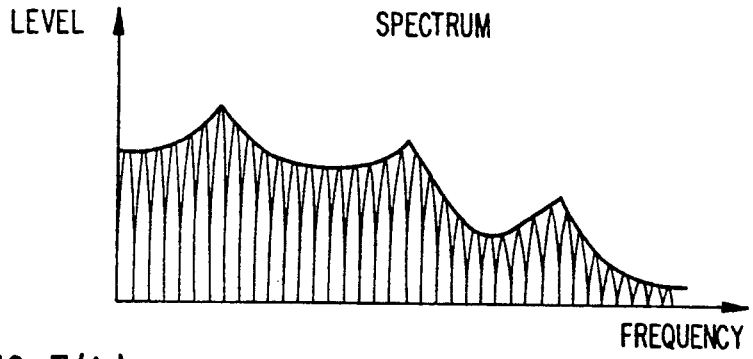
FIGS. 3*a*, 3*b* show corresponding graphs.
Figure 3B:
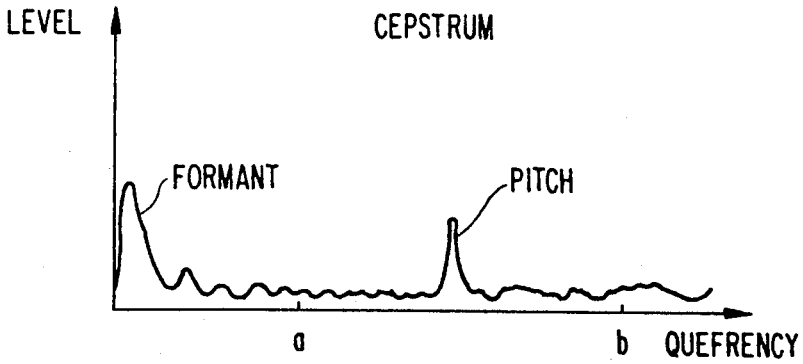

That is, the FFT means 1 fast-Fourier transforms a voice signal input, and supplies the transformed signal to the cepstrum analysis means 2. The cepstrum analysis means 2 determines a cepstrum of the spectrum signal, and supplies the cepstrum to the peak detection means 3 and the mean-value calculation means 4. FIG. 3 (*a*) shows a graph of such spectrum and (*b*) shows a graph of such cepstrum. The peak detection means 3 determines a peak of the cepstrum obtained by the cepstrum analysis means 2, and supplies the peak to the vowel/consonant detection means 5.

On the other hand, the mean-value calculation means 4 calculates a mean-value of the cepstrum obtained by the cepstrum analysis means 2, and supplies the mean-value to the vowel/consonant detection means 5. The vowel/consonant detection means 5 detects a vowel and a consonant of the voice signal input by use of the cepstrum peak supplied from the peak detection means 3 and the cepstrum mean-value supplied from the mean-value calculation means 4, and outputs the detected result as a detected output.

The operation of the voice signal processing device in the embodiment of the present invention configured as described above will be explained hereinafter.

A voice signal input is fast-Fourier transformed by the FFT means 1, determined for a cepstrum thereof by the cepstrum analysis means 2, and determined for a peak of the cepstrum by the peak detection means 3. Also, a mean-value of the cepstrum is determined by the mean-value calculation means 4. Then, the vowel/consonant detection means 5, when a signal indicating that the peak has been detected is inputted from the peak detection means 3, determines the voice signal input to be a vowel area. For the detection of a consonant, for example, when the cepstrum mean-value inputted from the mean-value calculation means 4 is larger than a predetermined value or when an increase of the cepstrum mean-value (differential coefficient) is larger than a predetermined value, the voice signal input is determined to be in the consonant area. As a result, a signal indicating a vowel/consonant, or a signal indicating a voice area including a vowel and a consonant is outputted.

According to the present invention as described above, the detecting of a vowel and a consonant allows the voice part detection to be accurately performed.

Another present invention will be explained hereinafter.

Figure 4:
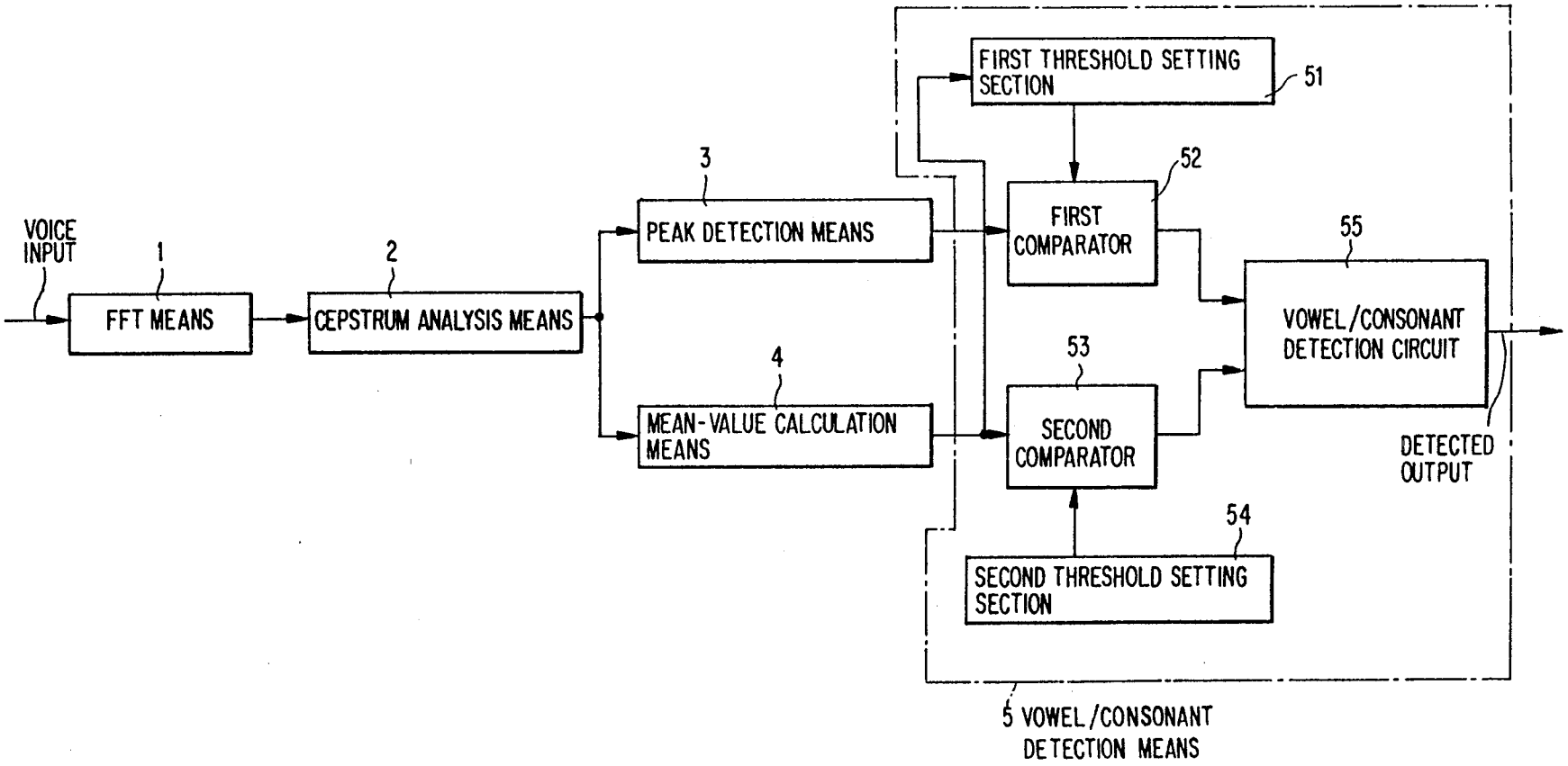
FIG. 4 is a block diagram showing an another embodiment of a voice signal processing device according to the present invention.

FIG. 4 is a block diagram showing an embodiment thereof. The same numeral is assigned to the same means as that in the embodiment of FIG. 2. That is, the numeral 1 indicates FFT means for fast-Fourier transforming a voice signal, the numeral 2 indicates cepstrum analysis means for determining a cepstrum of the Fourier-transformed spectrum signal, the numeral 3 indicates peak detection means for determining a peak on the basis of the cepstrum-analyzed result, and the numeral 4 indicates mean-value calculation means for calculating a mean-value of the cepstrum.

The vowel/consonant detection means 5 has means as described below.

That is, a first comparator 52 is a circuit which compares the peak information obtained by the peak detection means 3 with a specified threshold set by a first threshold setting section 51, and outputs the result. The first threshold setting section 51 is means for setting a threshold in response to the mean-value obtained by the mean-value calculation means 4.

A second comparator 53 is a circuit which compares a specified threshold set by a second threshold setting section 54 with the mean-value obtained by the mean-value calculation means 4, and outputs the result.

A vowel/consonant detection means 55 is a circuit which determines whether an inputted voice signal is a vowel or a consonant on the basis of the compared result obtained by the first comparator 52 and the compared result obtained by the second comparator 53.

The operation of the above embodiment will be explained hereinafter.

The FFT means 1 fast-Fourier transforms a voice signal. The cepstrum analysis means 2 determines a cepstrum of the Fourier-transformed signal. The peak detection means 3 detects a peak of the determined cepstrum. On the other hand, the mean-value calculation means 4 calculates a mean-value of the determined cepstrum.

Then, the first threshold setting means 51 sets a threshold as a criterion by which the peak obtained by the peak detection means 3 is determined to be a vowel or not. At that time, the means 51 sets the threshold with reference to the mean-value obtained by the mean-value calculation means 4. For example, where the mean-value is large, the threshold is set to be a high value so that a peak indicating a vowel can be surely selected.

The first comparator 52 compares the threshold set by the first threshold setting means 51 with the peak detected by the peak detection means 3, and outputs the compared result.

On the other hand, the second threshold setting means 54 sets a specified threshold. The specified threshold is such as a threshold of the mean-value itself, or a threshold of a differential coefficient indicating an increased mean-value tendency. Then, the second comparator 53 compares the mean-value obtained by the mean-value calculation means 4 with the threshold set by the second threshold setting means 54, and outputs the compared result. That is, the comparator 53 compares a calculated mean-value with a threshold mean-value, or compares an increase value of the calculated mean-value with a threshold differential coefficient value.

The vowel/consonant detection circuit 55 detects a vowel and a consonant on the basis of the compared result from the first comparator 52 and the compared result from the second comparator 53. When a peak has been surely detected with respect to the compared result from the first comparator 52, the area is determined to be a vowel. When a mean-value exceeds that of the threshold with respect to the compared result from the second comparator 53, the area is determined to be a consonant. Alternatively, the circuit 55 compares an increase of the mean-value with a differential coefficient of the threshold, and when the mean-value increase exceeds the threshold differential coefficient, the area is determined to be a consonant.

The detection by the vowel/consonant detection means 55 may be also performed in such a manner that, considering a characteristic of the area of voice vowel and consonant, for example, a characteristic that a consonant is accompanied by a vowel, a consonant is determined after when the consonant is accompanied by a vowel. That is, in order to perform more surely the discrimination of a noise from a consonant, if, even when a signal is determined to be a consonant by a mean-value thereof, thereafter no vowel area continues, the signal is determined to be a noise.

The present invention, though implemented in software utilizing a computer, may also be implemented by use of a dedicated hard circuit.

As apparent by the above description, the present invention comprises pitch extraction-analysis means for extracting a analyzing a pitch of a frequency-analyzed signal, pitch selection means for detecting a pitch in the analyzed output, mean-value calculation means for calculating a mean-value level in the pitch extracted and analyzed output, and vowel/consonant detection means for detecting a vowel from a consonant, on the basis of the pitch-detected information from the pitch selection means and of the mean-value information from the mean-value calculation means, by determining a vowel according to the pitch and determining a consonant according to the mean-value information level, whereby there is an effect that a vowel and a consonant can be surely detected to allow a voice to be correctly detected.

According to drawings, an embodiment of another present invention will be explained hereinafter.

Figure 5:
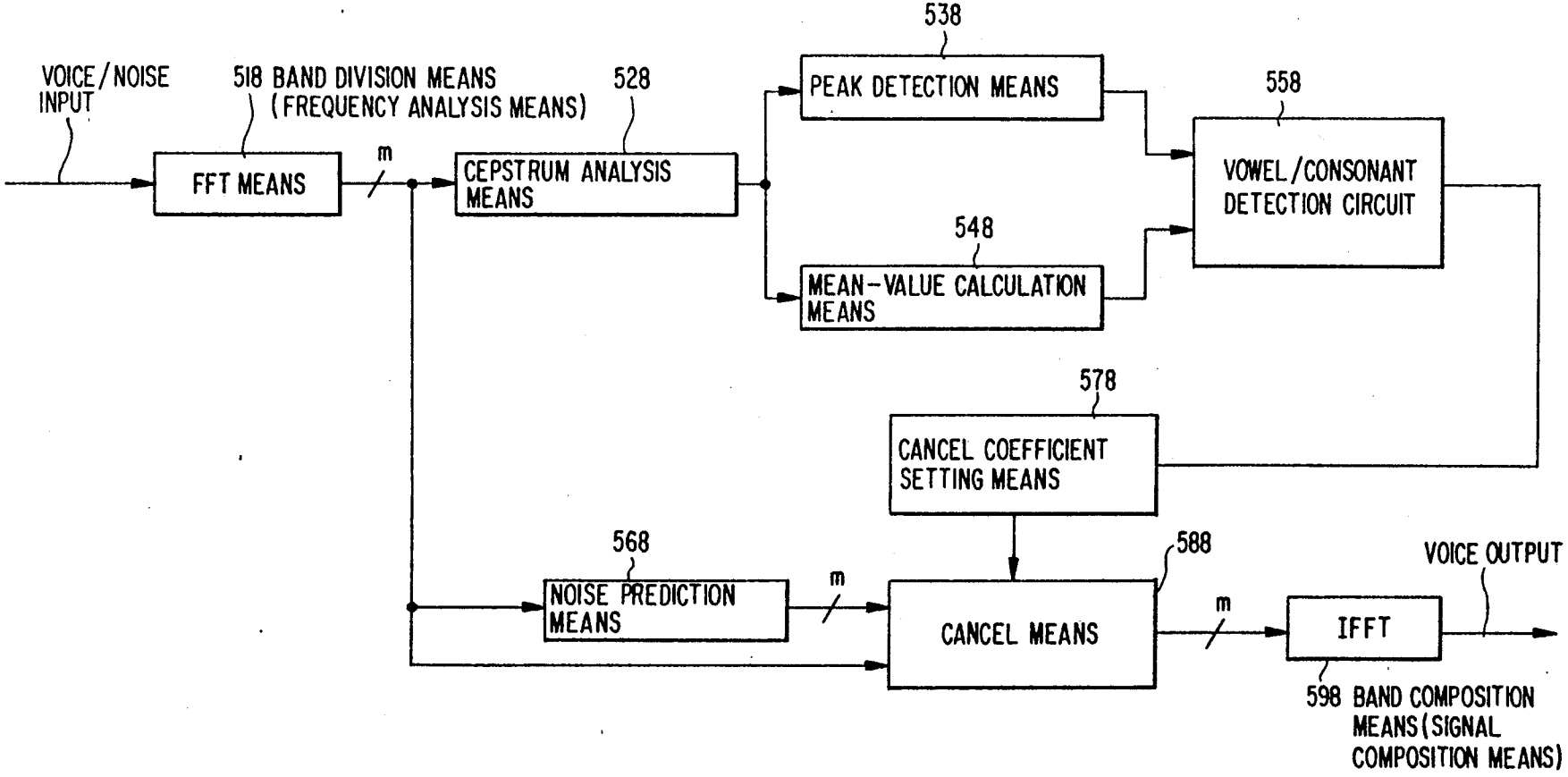
FIG. 5 is a block diagram showing still another embodiment of a voice signal processing device according to the present invention.

FIG. 5 is a block diagram of a voice signal processing device in an embodiment of the present invention. In FIG. 5, the numeral 518 indicates band division means for frequency-band dividing the signal, as an example of frequency analysis means for performing a frequency analysis of a signal, in particular, FET means for Fourier transforming the signal, the numeral 528 indicates cepstrum analysis means for performing a cepstrum analysis, the numeral 538 indicates peak detection means for detecting a peak of a cepstrum distribution, the numeral 548 indicates mean-value calculation means for calculating a mean-value of the cepstrum distribution, and the numeral 558 indicates vowel/consonant detection means for detecting a vowel and a consonant. That is, the FET means 518 fast-Fourier transforms a voice signal input, and supplies the transformed result to the cepstrum analysis means 528. The cepstrum analysis means 528 determines a cepstrum of the cepstrum signal, and supplies the cepstrum to the peak detection means 538 and the mean-value calculation means 548. FIG. 3 (*a*) and (*b*) show the graphs of such spectrum and cepstrum. The peak detection means 538 determines a peak of the cepstrum obtained by the cepstrum analysis means 528, and supplies the peak to the vowel/-consonant detection means 558.

Figure 6:
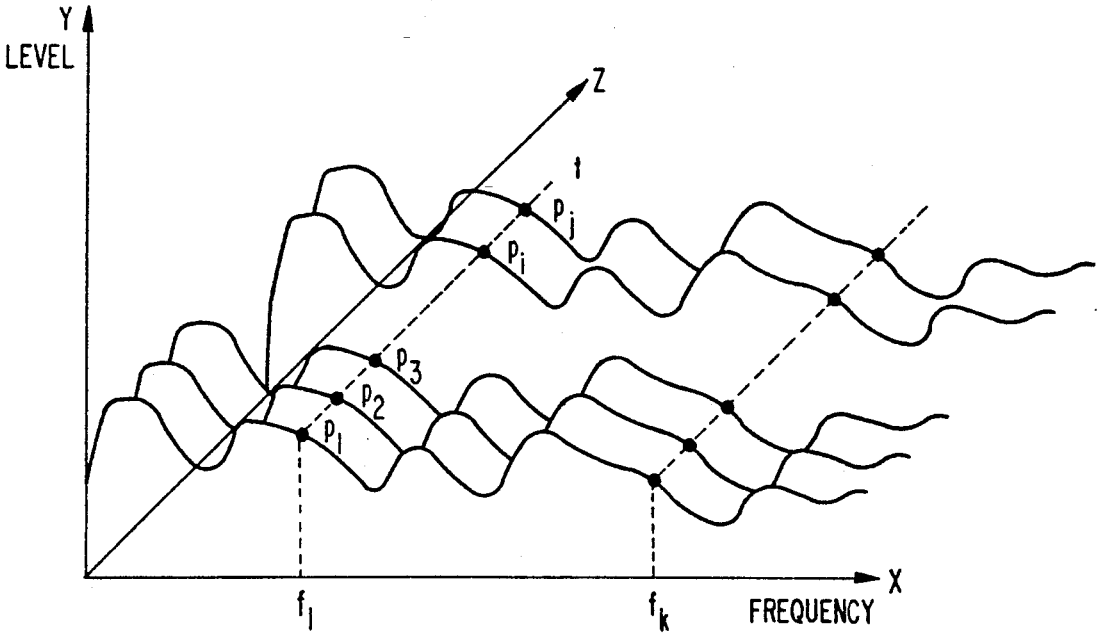
FIG. 6 is a graph to help explain a noise prediction method.

On the other hand, the mean-value calculation means 548 calculates a mean-value of the cepstrum obtained by the cepstrum analysis means 528, and supplies the mean-value to the vowel/consonant detection means 558. The vowel/consonant detection means 558 detects a vowel and a consonant of the voice signal input by use of the cepstrum peak supplied from the peak detection means 538 and the cepstrum mean-value supplied from the mean-value calculation means 548, and outputs the discriminated result. The numeral 568 indicates noise prediction means for inputting therein the outputted signal from the FFT 518 and predicting a noise component, the numeral 558 does cancel means for canceling the noise in a manner as described later, and the numeral 598 does band composition means as an example of signal composition means, in particular, IFFT means for performing an inverse-Fourier transformation. More specifically, the noise prediction means 568 predicts a noise component for each channel on the basis of a voice/noise input divided into m channels, and supplies the predicted result to the cancel means 588. For example, the noise prediction is performed in a manner as shown in FIG. 6. That is, by allowing the x axis to represent a frequency, the y axis to represent a noise level and the z axis to represent a time, and taking data $p_1$ and $p_2$ through $p_i$ at the frequency $f_1$, the preceding $p_j$ is predicted. For example by calculating a mean-value of the noise components $p_1$ through $p_i$, the mean-value is taken as $p_j$. Alternatively, when a voice signal portion continues thereafter, the $p_j$ is multiplied by an attenuation coefficient. The cancel means 588 is means to which a m channel signal from the FFT 1 and the noise prediction means 568 is supplied and which cancels a noise by subtracting the noise for each channel in response to a cancel coefficient input, and supplies the noise-canceled signal to the IFFT means 598. That is, the cancel means 588 cancels a noise by multiplying the predicted noise component by a cancel coefficient.

Figure 7A:
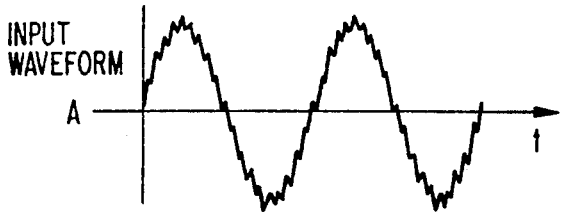
FIGS. 7*a*–7*c* and 8*a*–8*e* are wave form charts to help explain a cancellation method.
Figure 7B:
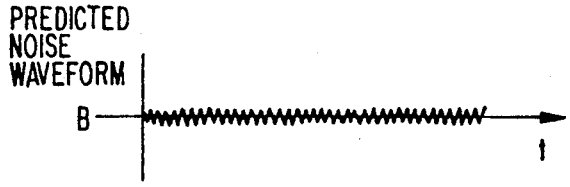
Figure 7C:
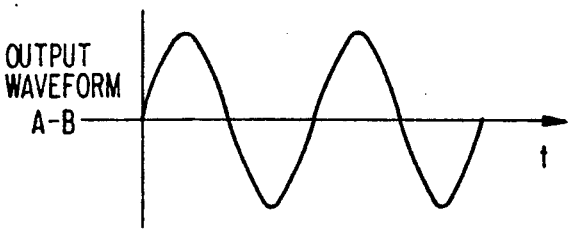
Figures 8A, 8B, 8C, 8D, 8E:
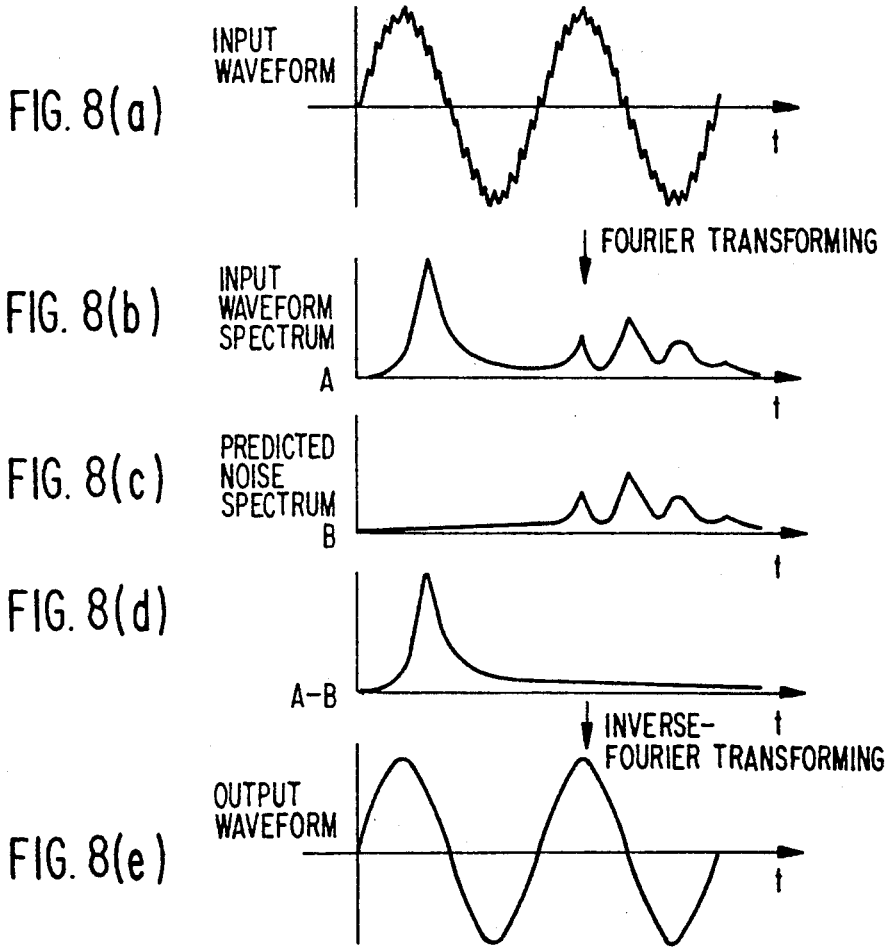

Generally, the cancellation with respect to the time axis as an example of a canceling method is performed by subtracting a predicted noise waveform (b) from a noise-contained voice signal (a). With such calculation, only the signal is taken out as shown in FIG. 7(*c*). Also, as shown in FIG. 8, the cancellation with a frequency as a reference is performed by Fourier transforming (b) a noise-contained voice signal (a), then subtracting (d) a predicted noise spectrum (c) from the transformed result, and then inverse-Fourier transforming the result to obtain a noise-canceled voice signal (e). The IFFT means 598 inverse-Fourier transforms the m channel signal supplied from the cancel means 588 to obtain a voice output.

Cancel coefficient setting means 578 sets properly a cancel coefficient utilizing the vowel/consonant area information detected by the vowel/consonant detection means 558. For example, in the voice area, in order to secure and obtain a good articulation by intentionally no-canceling the noise component, the cancel coefficient is rendered small, while, in another noise portion, in order to cancel completely the noise component, the cancel coefficient is rendered large. The present invention detects not only a vowel but also a consonant surely, thereby allowing a sufficiently good articulation of a voice to be obtained.

The operation of a voice signal processing device in the embodiment of the present invention configured as described above will be explained hereinafter.

A voice signal input is fast-Fourier transformed by the FFT means 518, determined for a cepstrum thereof by the cepstrum analysis means 528, and determined for a peak of the cepstrum by the peak detection means 538. Also, a mean-value of the cepstrum is determined by the mean-value calculation means 548. Then, the vowel/-consonant detection means 558, when a signal indicating that the peak has been detected is inputted from the peak detection means 538, determines the voice signal input to be a vowel area. For the detection of a consonant, for example, when the cepstrum mean-value inputted from the mean-value calculation means 548 is larger than a predetermined value or when an increase of the cepstrum mean-value (differential coefficient)is larger than a predetermined value, the voice signal input is determined to be consonant area. As a result, a signal indicating a vowel/consonant, or a signal indicating a voice area including a vowel and a consonant is outputted.

On the other hand, a noise-contained voice/noise input is predicted for the noise component thereof for each channel by the noise prediction means 568. The voice/noise signal is canceled for the noise component supplied from the noise prediction means 568 for each channel by the cancel means 588. The noise cancel ratio at that time is properly set in a manner to improve the articulation for each channel by a cancel coefficient input from the cancel coefficient setting means 578. For example, as described above, in the voice area, in order to secure and obtain a good articulation by intentionally no-canceling the noise component, the cancel coefficient is rendered small, while, in another noise portion, in order to cancel completely the noise component, the cancel coefficient is rendered large. The present invention detects surely also a consonant not limiting to a vowel, thereby allowing a sufficiently good articulation of a voice to be obtained. Then, the IFFT means 598 inverse-Fourier transforms the noise-canceled m-channel signal obtained from the cancel means 588, and outputs the transformed signal as a voice signal.

According to the present embodiment as described above, the noise cancel ratio of the cancel means 588 is properly given for each band by a cancel coefficient input, and the cancel coefficient input corresponding to a voice is selected with a high accuracy, thereby allowing an articulated and noise-suppressed voice output to be obtained.

An embodiment of another present invention will be explained herein-after.

FIG. 9 is a block diagram showing an embodiment thereof. The same numeral is assigned to the same means as that in the embodiment of FIG. 5. That is, the numeral 518 indicates FFT means for fast-Fourier transforming a voice signal, the numeral 528 indicates cepstrum analysis means for determining a cepstrum of the Fourier-transformed spectrum signal, the numeral 538 indicates peak detection means for determining a peak on the basis of the cepstrum-analyzed result, the numeral 548 indicates mean-value calculation means for calculating a mean-value of the cepstrum, the numeral 568 does noise prediction means, the numeral 588 indicates cancel means, the numeral 598 indicates IFFT means, and the numeral 578 indicates cancel coefficient setting means. Vowel/consonant detection means 558 has the following means as described in FIG. 4. That is, a first comparator 552 is a circuit which compares the peak information obtained by the peak detection means 53 with a specified threshold set by a first threshold setting section 551, and outputs the result. The first threshold setting section 551 sets the threshold in response to the mean-value obtained by the mean-value calculation means 548.

Also, a second comparator 553 is a circuit which compares the a specified threshold set by a second threshold setting section 554 with mean-value obtained by the mean-value calculation means 548, and outputs the result.

Also, vowel/consonant detection circuit 555 determines whether an inputted voice signal is a vowel or a consonant on the basis of the compared result obtained by the first comparator 552 and the compared result obtained by the second comparator 553.

The operation of the above embodiment will be explained hereinafter.

The FFT means 518 fast-Fourier transforms a voice signal. The cepstrum analysis means 52B determines a cepstrum of the Fourier-transformed signal. The peak detection means 538 detects a peak of the determined cepstrum. On the other hand, the mean-value calculation means 548 calculates a mean-value of the determined cepstrum.

Then, the first threshold setting means 551 sets a threshold as a criterion by which the peak obtained by the peak detection means 538 is determined to be a vowel or not. At that time, the means 551 sets the threshold with reference to the mean-value obtained by the mean-value calculation means 548. For example, where the mean-value is large, the threshold is set to a high value so that a peak indicating a vowel can be surely selected.

The first comparator 552 compares the threshold set by the first threshold setting means 551 with the peak detected by the peak detection means 538, and outputs the compared result.

On the other hand, the second threshold setting means 554 sets a specified threshold. The specified threshold is such as a threshold of mean-value itself, or a threshold of a differential coefficient indicating an increased mean-value tendency. Then, the second comparator 553 compares the mean-value obtained by the mean-value calculation means 548 with the threshold set by the second threshold setting means 554, and outputs the compared result. That is, the comparator 553 compares a calculated mean-value with a threshold mean value, or compares an increase value of the calculated mean-value with a threshold differential coefficient value.

The vowel/consonant detection circuit 555 detects a vowel and a consonant on the basis of the compared result from the first comparator 552 and the compared result from the second comparator 553. When a peak has been surely detected with respect to the compared result from the first comparator 552, the area is determined to be a vowel. When a mean-value exceeds that of the threshold with respect to the compared result from the second comparator 553, the area is determined to be a consonant. Alternatively, the circuit 555 compares an increase of the mean-value with a differential coefficient of the threshold, and when the mean-value exceeds the threshold, the area is determined to be a consonant.

The detection by the vowel/consonant detection means 55 may be also performed in such a manner that, considering a characteristic of the area of voice vowel and consonant, for example, a characteristic that a consonant is accompanied by a vowel, a consonant is determined after when the consonant is accompanied by a vowel. That is, in order to perform more surely the discrimination of a noise from a consonant, if, even when a signal is determined to be a consonant by a mean-value thereof, thereafter no vowel area continues, the signal is determined to be a noise.

The cancel coefficient setting means 579 sets a proper cancel coefficient on the basis of the voice information of the vowel/consonant area discriminated by the vowel/consonant detection means 558.

Figure 10A:
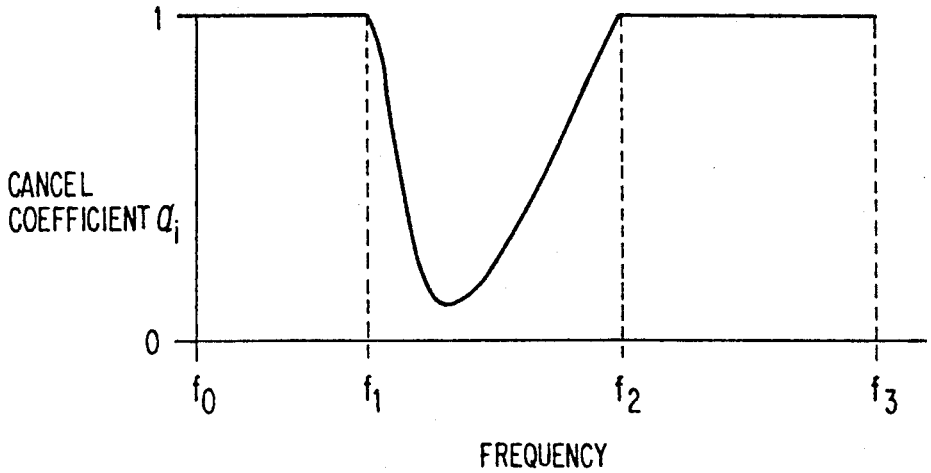
FIGS. 10*a*, 10*b* are graphs to help explain a cancel coefficient.
Figure 10B:
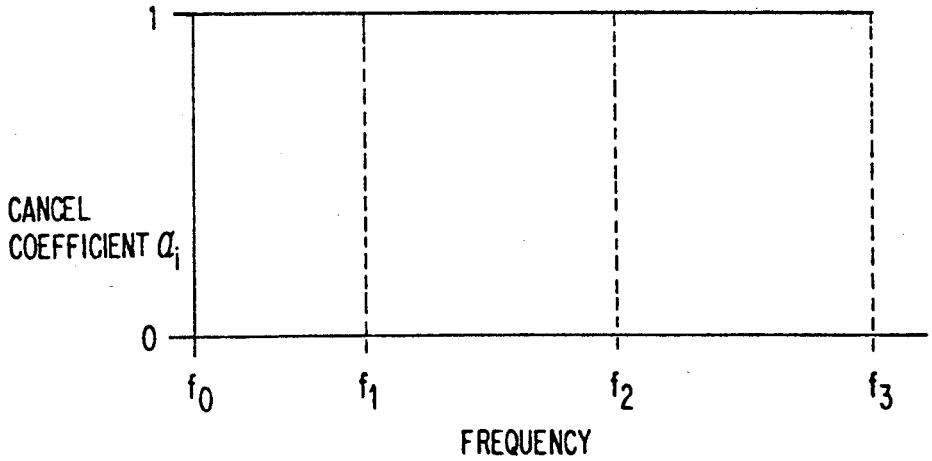

On the other hand, a noise-contained voice/noise output is predicted for the noise component thereof for each channel by the noise prediction means 56B. Also, a voice signal is canceled for the noise component thereof supplied from the noise prediction means 568 for each channel by the cancel means 588. The noise cancel ratio at that time is set for each channel by a cancel coefficient supplied from the cancel coefficient setting means 579. That is, when a predicted noise component represents $a_i$, a noise-contained signal $b_i$ and a cancel coefficient $alpha_i$, an output $c_i$ of the cancel means 588 becomes ($b_i$-$alpha_i \times a_i$). The cancel coefficient $alpha_i$ is a coefficient value as shown in FIG. 10. That is, FIG. 10 (*a*) shows a cancel coefficient in each band, wherein the $f_o$–$f_3$ indicates the entire band of a voice/noise input. A cancel coefficient is set by dividing the $f_o$–$f_3$ into m channels. Particularly, the $f_1$–$f_2$ indicates a band containing a voice, and is surely determined by the vowel/consonant detection means 558 as described above. Thus, in the voice band, a cancel coefficient is rendered small (close to zero) so that a noise is canceled as little as possible. That causes the articulation to be improved. That is because that a human hearing sense can hear a voice even with noise to some extent. In the non-voice bands $f_0$–$f_1$ and $f_2$–$f_3$, a noise is to be sufficiently canceled by taking the cancel coefficient as 1. The cancel coefficient of FIG. 10 (*b*) is used when it has been surely found that a signal is considered to have no voice and have only a noise, which is to be taken as 1 so that the noise can be sufficiently canceled. For example, that corresponds to a case where, when a signal with no vowel continues from the view point of peak frequency, the signal is determined not to be a voice signal and accordingly, to be a noise. It is preferable that the cancel coefficients of FIG. 10 (*a*) and (*b*) can be shifted as appropriate.

The present invention, though implemented in software utilizing a computer, may also be implemented by use of a dedicated hard circuit.

As apparent by the above description, a voice signal processing device according to the present invention detects the vowel/consonant area of a noise-contained voice signal, and on the basis of the detected area, sets a proper cancel coefficient by coefficient setting means, and then utilizing the cancel coefficient, cancels properly a predicted noise component, thereby allowing the noise to be canceled and the articulation to be improved.

It is further understood by those skilled in the art that the foregoing description is a preferred embodiment and that various changes and modifications may be made in the invention without departing from the spirit and scope thereof.

What is claimed is:

1. A voice signal processing device comprising:

frequency analysis means for frequency analyzing a voice input signal to provide an output;

pitch extraction-analysis means for pitch extracting and analyzing the output from said frequency analysis means to provide a pitch-extracted and analyzed output;

pitch detection means for detecting a pitch of the pitch-extracted and analyzed output to provide pitch-detected information;

mean-value calculation means for calculating a mean-value level of the analyzed output from said pitch extraction-analysis means to provide mean-value level information; and vowel/consonant detection means for detecting a vowel on the basis of the pitch-detected information from said pitch detection means, and a consonant on the basis of the mean-value level information from said mean-value calculation means.

2. A voice signal processing device comprising:

band division means for band dividing a voice input signal to provide a band-divided output;

cepstrum analysis means for cepstrum analyzing the band-divided output to provide a cepstrum-analyzed output;

peak detection means for detecting a cepstrum peak in the cepstrum-analyzed output from said cepstrum analysis means to provide peak-detected information;

mean-value calculation means for calculating a mean-value level of the cepstrum-analyzed output from said cepstrum analysis means to provide mean-value level information; and vowel/consonant detection means for detecting a vowel on the basis of the peak-detected information from said peak detection means, and a consonant on the basis of the mean-value level information from said mean-value calculation means.

3. A voice signal processing device in accordance with claim 2, wherein the vowel/consonant detection means comprises;

a first comparator for comparing the peak described by the peak-detected information from said peak detection means with a threshold set by a first threshold setting section;

a second comparator for comparing the mean-value level calculated by said mean-value calculation means with a specified threshold set by a second threshold setting section; and a vowel/consonant detection circuit for detecting a vowel and a consonant on the basis of the compared results from said first and the second comparators, and for outputting the detected result.

4. A voice signal processing device comprising:

frequency analysis means for frequency analyzing a voice input signal to provide a frequency-analyzed output, the frequency-analyzed output comprising a Fourier transformed voice signal;

cepstrum analysis means for cepstrum analyzing the frequency-analyzed output from said frequency analysis means to provide a cepstrum-analyzed output;

peak detection means for detecting a cepstrum peak in the cepstrum-analyzed output from said cepstrum analysis means to provide peak-detected information;

mean-value calculation means for calculating a mean-value level of the cepstrum-analyzed output from said cepstrum analysis means to provide mean-value level information;

vowel/consonant detection means for detecting a vowel on the basis of the peak-detected information from said peak detection means, and a consonant on the basis of the mean-value level information from said mean-value calculation means;

cancel coefficient setting means for setting a cancel coefficient utilizing detection results from the vowel/consonant detection means;

noise prediction means to which the Fourier-transformed voice signal from said frequency analysis means is applied, said noise prediction means predicting a noise component in the transformed voice signal to provide a noise-predicted output;

cancel means to which the noise-predicted output from said noise prediction means, the voice signal, and the cancel coefficient signal set by said cancel coefficient setting means are applied, said cancel means cancelling a noise component, based upon a cancel ratio, from the voice signal to provide a noise-canceled output signal; and signal composition means for composing a composed signal based upon the noise-canceled output signal from said cancel means.

5. A voice signal processing device comprising:

band division means for band dividing a voice input signal to provide a band-divided output, the band-divided output comprising a Fourier transformed voice signal;

cepstrum analysis means for cepstrum analyzing the band-divided output from said band division means to provide a cepstrum-analyzed output;

peak detection means for detecting a cepstrum peak in the cepstrum-analyzed output from said cepstrum analysis means to provide peak-detected information;

means-value calculation means for calculating a mean-value level of the cepstrum-analyzed output from said cepstrum analysis means to provide mean-value level information;

vowel/consonant detection means for detecting a vowel on the basis of the peak-detected information from said peak detection means, and a consonant on the basis of the mean-value level information from said mean-value calculation means;

cancel coefficient setting means for setting a cancel coefficient utilizing detection results from the vowel/consonant detection means;

noise prediction means to which the Fourier-transformed voice signal from said frequency analysis means is applied, said noise prediction means predicting a noise component in the transformed voice signal to provide a noise-predicted output;

cancel means to which the noise-predicted output from said noise prediction means, the voice signal, and the cancel coefficient signal set by said cancel coefficient setting means are applied, said cancel means cancelling a noise component, based upon a cancel ratio, from the voice signal to provide a noise-cancelled output signal; and band composition means for band composing a composed signal based upon the noise-cancelled output signal from said cancel means.

6. A voice signal processing device in accordance with claim 5, wherein the vowel/consonant detection means comprises at least:

a first comparator for comparing the peak described by the peak-detected information from said peak detection means with a first threshold set by a threshold setting section;

a second comparator for comparing the mean-value level calculated by said mean-value calculation means with a specified threshold set by a second threshold setting section; and a vowel/consonant detection circuit for detection a vowel and a consonant on the basis of the compared results from the first and the second comparators, and outputting the detected result.

* * * * *